United States Patent [19]

Storey

[11] 4,027,477

[45] June 7, 1977

[54] DUAL SENSOR CLOSED LOOP FUEL CONTROL SYSTEM HAVING SIGNAL TRANSFER BETWEEN SENSORS DURING WARMUP

[75] Inventor: Edwin C. Storey, Rochester, N.Y.

[73] Assignee: General Motors Corporation, Detroit, Mich.

[22] Filed: Apr. 29, 1976

[21] Appl. No.: 681,533

[52] U.S. Cl. ..... 60/276; 123/32 EE

[51] Int. Cl.[2] ..... F02B 3/00

[58] Field of Search ..... 123/32 EE, 119 EC; 60/276, 285

[56] References Cited

UNITED STATES PATENTS

| | | | |
|---|---|---|---|
| 3,939,654 | 2/1976 | Creps | 60/276 |
| 3,962,866 | 6/1976 | Neldhard et al. | 60/276 |

*Primary Examiner*—Ronald B. Cox

*Attorney, Agent, or Firm*—H. N. Conkey

[57] ABSTRACT

A closed loop fuel control system for an internal combustion engine having a catalytic converter in its exhaust system and a pair of zirconia sensors for generating respective signals indicative of the air-fuel ratio in the gases upstream and downstream of the catalytic converter. These sensors are used in the control system to control the rate of flow of fuel or air to the engine in response to the sensor signals to maintain a constant stoichiometric air-fuel ratio in the exhaust system for maximum catalytic converter efficiency in simultaneous oxidation and reduction. A circuit is described for imposing the output of the zirconia sensor upstream from the catalytic converter across the zirconia sensor downstream of the catalytic converter until the zirconia sensor downstream of the catalytic converter reaches its operating temperature.

2 Claims, 2 Drawing Figures

DUAL SENSOR CLOSED LOOP FUEL CONTROL SYSTEM HAVING SIGNAL TRANSFER BETWEEN SENSORS DURING WARMUP

BACKGROUND OF THE INVENTION

This invention is directed to a control system for use with a catalytic converter for reducing undesirable substances in the exhaust gases of internal combustion engines.

It is well known that exhaust gases from an internal combustion engine can be catalytically treated to reduce the amounts of hydrocarbons, carbon monoxide and oxides of nitrogen, the catalytic treatment including oxidation of carbon monoxide and hydrocarbons and reduction of nitrogen oxides.

A single catalytic device may be utilized to accomplish both the oxidation and reduction necessary for minimizing the undesirable exhaust components provided that the air-fuel mixture supplied to the catalytic converter is maintained within a narrow range (hereinafter referred to as the converter window) at stoichiometry, the ratio containing fuel and oxygen in such proportions that, in perfect combustion, both would be completely consumed. Numerous fuel control systems have been suggested in which the air-fuel ratio of the mixture supplied to the internal combustion engine is controlled by feedback from an exhaust sensor for maintaining the gases supplied to the converter within the converter window. One such system is described in U.S. Pat. No. 3,939,654 issued on Feb. 24, 1976, and which is assigned to the assignee of this invention, the contents of which is hereby incorporated by reference. As described in this patent, two zirconia sensors are utilized in a control system wherein the first zirconia sensor is exposed to the exhaust gases upstream from a catalytic converter and a second zirconia sensor is exposed to the exhaust gases downstream from the catalytic converter. The signals from the zirconia sensors are combined and fed back through appropriate control elements to vary the air-fuel ratio of the engine mixture in order to maintain the air-fuel ratio of the mixture supplied to the catalytic converter within the converter window to optimize the oxidation and reduction necessary to minimize the undesirable exhaust constituents. The zirconia sensor downstream from the catalytic converter exhibits sharper sensitivity to a change in air-fuel ratio and provides a signal which maintains the system within the converter window over time without drift and the zirconia sensor upstream from the catalytic converter provides a quicker response, since it does not involve the time delay introduced by the catalytic converter, to reduce transient swings out of the converter window and helps reduce the required gain in the feedback loop to improve stability of the system.

In the system using the two zirconia sensors, during initial operation of the vehicle engine, the first zirconia sensor upstream from the catalytic converter is quickly heated to its operating temperature at which it provides an output voltage representing the air-fuel ratio of the exhaust gases upstream from the catalytic converter. However, the zirconia sensor downstream of the catalytic converter is not heated to its operating temperature for a time delay which is imposed by the catalytic converter. For this period, the zirconia sensor downstream of the catalytic converter is inoperative to produce a useable voltage signal representative of the air-fuel ratio of the exhaust gases downstream of the catalytic converter. This would normally command a rich air-fuel mixture. However, during this catalytic converter imposed time delay, the control system operates to control the mixture of air and fuel to the internal combustion engine to the lean side of stoichiometry. After the zirconia sensor downstream of the catalytic converter is heated to its operating temperature, it is then effective to supply a voltage indicating the air-fuel ratio so that the control system functions to control the air-fuel mixture supplied to the engine at stoichiometry.

SUMMARY OF THE INVENTION

This invention is directed to a two sensor control circuit for use in a closed loop fuel control system as described in the aforementioned patent wherein the output signal representing air-fuel ratio of the zirconia sensor whose temperature first reaches its operating temperature is imposed on the other one of the zirconia sensors or substituted for the output of the other one of the zirconia sensors until such time that the second zirconia sensor is heated to its operating temperature at which it produces a signal representative of the air-fuel ratio. In this manner, the closed loop fuel control system is operative to control the air-fuel ratio of the mixture supplied to the internal combustion engine near stoichiometry while the second zirconia sensor is being heated to its operating temperature.

This is accomplished by means of a circuit for imposing the output of the zirconia sensor upstream of the catalytic converter across the zirconia sensor downstream of the catalytic converter when the impedance of the zirconia sensor downstream of the catalytic converter is very high during its warmup and during which it supplies a low output voltage signal.

DESCRIPTION OF THE PREFERRED EMBODIMENT

Figure 1:
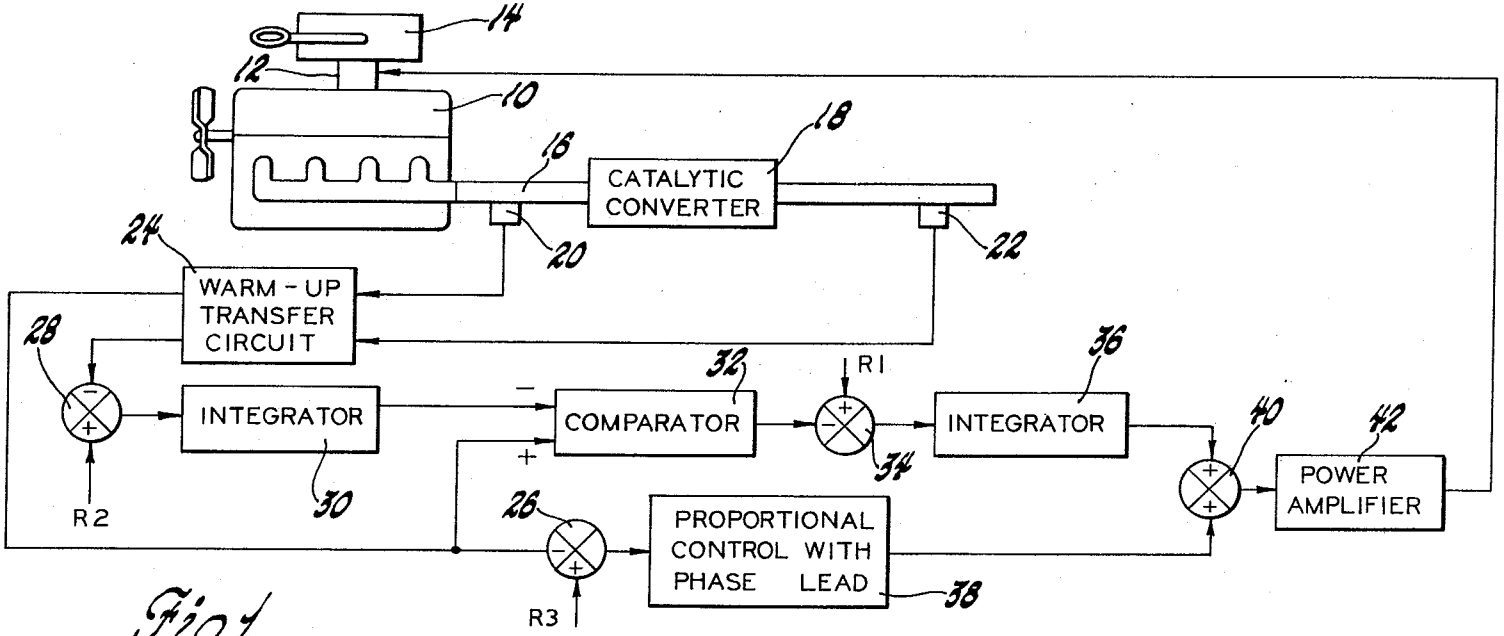
FIG. 1 illustrates a closed loop fuel control system incorporating the principles of this invention.

Referring to FIG. 1, an internal combustion engine 10 is supplied with a mixture of fuel and air through appropriate conventional supply means which, in this embodiment, includes a carburetor 12 and an air cleaner 14, although the supply means could take the form of fuel injection apparatus or other means.

The engine 10 exhausts its spent gases through an exhaust conduit 16 including a catalytic converter 18. The catalytic converter 18 is a device of the type in which exhaust gases flowing therethrough are exposed to a catalytic substance such as platinum or palladium which, given the proper air-fuel ratio in the exhaust gases, will promote simultaneous oxidation of carbon monoxide and hydrocarbons and the reduction of oxides of nitrogen. The exhaust conduit 16 is provided with a first oxygen sensor 20 upstream from the catalytic converter 18 and a second oxygen sensor 22 downstream from the catalytic converter 18. Oxygen sensors 20 and 22 are preferably of zirconia electrolyte type which, when exposed to hot engine exhaust gases and heated to their operating temperature thereby, generate an output voltage which changes appreciably as the air-fuel ratio of the exhaust gases passes through the stoichiometric level. Such sensors are well known in the art, a typical example being that shown in the U.S. Pat. No. 3,844,920 to Burgett et al., dated Oct. 29, 1974. The output voltages of the sensors 20 and 22 achieve their highest levels with rich mixtures and their lowest levels with lean mixtures and exhibit a fairly steep slope as the mixture passes through stoichiometry. The sensor 22 exhibits a steeper slope through stoichiometry than the sensor 21 due to the action of the catalytic converter 18 in bringing the exhaust gases to chemical equilibrium. The result is a signal which provides a very accurate indication of the converter window or narrow range about stoichiometry where optimum catalytic converter performance occurs and is also found to be insensitive in vehicle applications to driving conditions over a wide range of speeds and loads. In addition, the action of the catalytic converter 18 in averaging out individual cylinder firings as well as maldistribution affects that may be present in the exhaust gases proceeding from the engine 10 causes the signal from the sensor 22 to be insensitive to car-to-car or cylinder-to-cylinder variations in mixture distribution. For these reasons, the output of the sensor 22 is the preferred signal for establishing a long-term operating point in the engine fuel control system.

The catalytic converter 18, however, introduces a time delay in the sensing of a change in the exhaust gases at the sensor 22 compared with the sensing of the same change in the exhaust gases upstream of the catalytic converter 18, such as would be sensed by the sensor 20 and reflected in the output voltage thereof. Although the sensor 20 is not as accurate a measure of operation at the converter window as is the sensor 22 and might, by itself, allow the operating point to drift from the converter window, it provides a quicker response to changes in the air-fuel ratio within the exhaust conduit 16 and thus, used in combination with the sensor 22, contributes significantly to the dynamic performance of the system.

The method by which the output voltage signals from the sensors 20 and 22 are combined is illustrated in FIG. 1. The output voltage signals from the sensors 20 and 22 are coupled to a warmup transfer circuit 24, whose function during the warmup period of the sensors 20 and 22 will hereinafter be described, which after the sensors 20 and 22 have been heated to their operating temperatures, couples the voltage signal output of the sensor 20 to the negative input of a summer 26 and couples the voltage signal output of the sensor 22 to the negative input of a summer 28. The summer 28 computes the difference between the voltage signal coupled thereto from the warmup transfer circuit 24 and a fixed reference R2, which difference is provided to an integrator 30. The reference R2 is set equal to the voltage signal from the sensor 22 indicative of the center of the converter window at the sensor 22 so that, as long as such a condition exists, the output of the integrator 30 will be unchanging. When the output signal from the sensor 22 varies in either direction from the reference R2, the output of the integrator 30 will increase or decrease accordingly. The output of the integrator 30 and the signal from the sensor 20 supplied to the negative input of the summer 26 by the warmup transfer circuit 24 are fed to the two inputs of a comparator 32, the output of which is a signal that is either a constant high voltage or a constant low voltage, depending on which input is the greater. The difference between the output of the comparator 32 and the reference R1 is obtained by a summer 34 having the output of the comparator 32 coupled to its negative input and the reference R1 coupled to its positive input. The reference R1 is chosen to be a constant voltage midway between the high and low levels of the output of the comparator 32 so that the output of the summer 34 is a signal whose voltage level always has the same absolute value but varies in sign with the output of the comparator 32. The summer 34 output is supplied to an integrator 36. The comparator 32, the summer 34 and the reference R1 are used to combine the output voltage signal from the sensor 20 with the output of the integrator 30 to provide a constant integration gain to the integrator 36.

In order to improve stability while maintaining high integrator gain for quick response, the system includes proportional control by the voltage signal from the sensor 20. This is accomplished by taking the difference between the voltage signal supplied to the negative input of the summer 26 and a reference R3 supplied to the positive input of the summer 26 with the difference being applied to a proportional control 38, which may also include phase lead elements. The output of the proportional control 38 is combined with the output of the integrator 36 at a summer 40, the output of which controls a power amplifier 42. The output of the power amplifier 42 is applied to an air-fuel ratio control means associated with the carburetor 12. An example of an air-fuel ratio control means is illustrated in the aforementioned U.S. Pat. No. 3,939,654 to which reference may be made for the specific details thereof. The air-fuel ratio control means associated with the carburetor 12 functions to control the mixture of air and fuel supplied to the internal combustion engine 10 at stoichiometry.

The zirconia sensors 20 and 22 each have a negative temperature coefficient of resistance with a very large resistance in the order of many MEG ohms at the ambient temperatures surrounding the engine 10 and with a low resistance in the order of 100 ohms at their typical operating temperatures of 800° F. Further, the sensors 20 and 22 are inoperative to produce a useable output voltage signal representative of air-fuel ratio until they have been heated to their operating temperature which may be in the order of 800° F. When the internal combustion engine 10 is first operated, both of the sensors 20 and 22 are at the ambient temperature surrounding the engine 10 and consequently are substantially below their operating temperatures. At these ambient temperatures, the sensors 20 and 22 do not generate useable voltage signals representative of air-fuel ratio and have impedances in the order of many meg ohms. The sensor 20 is quickly heated to its operating temperature such as 800° F. by the exhaust gases from the internal combustion engine 10 after initiation of its operation. A typical time for the sensor 20 to reach its operating temperature and thereby produce a voltage indicative of the air-fuel ratio of the exhaust gases upstream from the catalytic converter 18 may be 10 to 30 seconds. During this time period, the resistance of the sensor decreases to, for example, 100 ohms. However, the sensor 22 is not heated to its operating temperature of 800° F. by the exhaust gases downstream of the catalytic converter 18 for a time delay imposed by the exhaust gases traversing the catalytic converter 18 and the heat transfer between the exhaust gases and the catalytic converter 18. For example, the sensor 22 may not be heated to its operating temperature for a time period of approximately three minutes after initiation of the operation of the internal combustion engine 10. During this time period, the circuit of FIG. 1 would, without the warmup transfer circuit 24, be inoperative to control the air-fuel mixture to the engine 10 at stoichiometry. So as to minimize the time that the control system of FIG. 1 is inoperative to control the air-fuel ratio of the mixture supplied to the internal combustion engine 10 at the converter window, the warmup transfer circuit 24 is provided which supplied the output voltage signal from the sensor 20 which is heated to its operating temperature relatively rapidly, to the negative input of the summer 28 until such time that the sensor 22 is heated to its operating temperature to thereby provide a useable signal representative of the air-fuel ratio. In this manner, the control system of FIG. 1 is operative, when the sensor 20 is heated to its operating temperature, to control the air-fuel mixture supplied to the engine 10 near stoichiometry during the catalytic converter imposed time delay during which the sensor 22 is being heated to its operating temperature.

Figure 2:
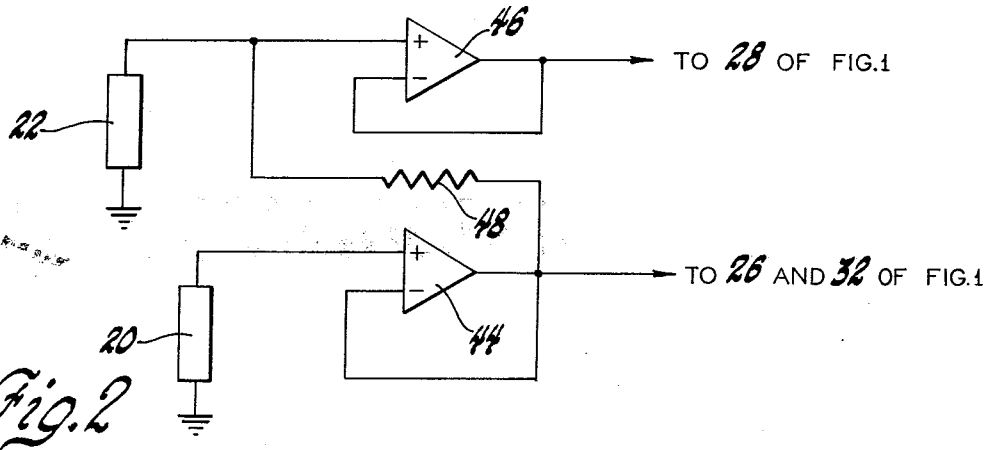
FIG. 2 is a schematic drawing of the circuit for imposing the output of one zirconia sensor across the other zirconia sensor.

The warmup transfer circuit 24 for imposing the output of the sensor 20 at the summer 28 while the sensor 22 is being heated to its operating temperature is illustrated in FIG. 2.

The voltage signal generated by the sensor 20 is coupled to the positive input of an operational amplifier 44 whose output is coupled to its negative input to provide unity gain. The output voltage from the sensor 22 is coupled to the positive input of operational amplifier 46 whose output is coupled to its negative input to provide unity gain. The output of the operational amplifier 44 representing the voltage signal generated by the sensor 20 is coupled to the positive input of the operational amplifier 26 through a transfer resistor 48. The operational amplifiers 44 and 46 have very large input impedances which may be typically in the order of 100 meg ohms. The resistor 48 has a resistance value which is much less than the resistance of the sensor 22 when the temperature thereof is at the ambient temperature surrounding the engine 10 and much less then the input impedance of the operational amplifier 46. For example, the resistor 48 may have a value of 750 K ohms.

When operation of the internal combustion engine 10 is initiated, the sensor 20 is quickly heated to its operating temperature to generate a voltage signal representing the air-fuel ratio in the exhaust gases upstream of the catalytic converter 18. This signal is supplied to the operational amplifier 44 whose output corresponds to the voltage signal. This signal is supplied to the negative input of the summing junction 26 of FIG. 1 and also to the positive input of the operational amplifier 46 through the resistor 48. Since the resistance of the sensor 22 and the input impedance of the amplifier 46 are very large relative to the resistance of the resistor 48 and since the sensor 22 is inoperative to generate a useable voltage signal when cold, the signal applied to the positive input of the operational amplifier 46 is substantially equal to the output of the operational amplifier 44 and consequently the output of the sensor 20 representing the air-fuel ratio sensed thereby. The output of the operational amplifier 46 is therefore substantially equal to the voltage signal generated by the sensor 20 and is applied to the summer 28 to be summed with the reference R2. The control system of FIG. 1 is responsive to these signals to control the air-fuel ratio near stoichiometry.

During the time delay imposed by the catalytic converter 18, the sensor 22 is heated toward its operating temperature and its resistance decreases accordingly. Further, the sensor 22 begins to generate a voltage signal in response to the air-fuel ratio sensed hereby. As the sensor 22 heats up and its impedance drops accordingly, the effect of the output of the operational amplifier 44 on the output of the amplifier 46 gradually decreases due to the voltage division of the resistor and the sensor 22 and the voltage signal generated by the sensor 22, while the effect of the voltage being generated by the sensor 22 on the output of the amplifier 46 increases. When the sensor 22 is heated to its operating temperature with its associated resistance and output voltage signal, the effect of the output of the operational amplifier 44 on the output of the operational amplifier 46 is virtually nonexistent and the output of the operational amplifier 46 corresponds to the output of the sensor 22. In this respect, the resistance of the resistor 48 is substantially larger than the resistance of the sensors 20 and 22 at their operating temperatures to effectively isolate their output signals.

During the time period that the sensor 22 is being heated to its operating temperature, the control system is controlled essentially by the output of the sensor 20. Thereafter, the system is controlled in accordance with the respective outputs of the sensors 20 and 22 as previously described. The transition between the signals from the sensors 20 and 22 at the output of the operational amplifier 46 may be controlled by controlling the value of resistance of the resistor 48. Further, the output of the operational amplifier 46 may be made any fraction of the output of the sensor 20 by adding a resistor in parallel with the sensor 22.

What has been described is a control system for controlling the air-fuel ratio of the mixture supplied to an internal combustion engine in response to signals generated by a pair of air-fuel ratio sensors located upstream and downstream respectively of a catalytic converter and in which the output of the sensor first to heat to its operating temperature is imposed across the sensor last to be heated to its operating temperature to thereby provide improve air-fuel ratio control during the time period of sensor warmup.

The above description of a preferred embodiment of the invention for the purpose of explaining the principles thereof is not to be considered as limiting or restricting the invention since many modifications may be made by the exercise of skill in the art without departing from the scope of the invention.

What is claimed is:

1. For use with an internal combustion engine including means effective to supply air and fuel thereto in variable ratio and exhaust means including a catalytic converter effective, when supplied with exhaust gases containing air and fuel in a certain ratio, to accelerate simultaneously the oxidation of unburned fuel and the reduction of nitrogen oxides, apparatus for controlling the ratio of air and fuel in the exhaust system to the certain ratio, the apparatus comprising in combination:

a first air-fuel ratio sensor exposed to the exhaust gases in the exhaust means upstream from the catalytic converter, the first air-fuel ratio sensor having a negative temperature coefficient of resistance and being effective to generate a voltage thereacross when heated to a specified operating temperature that represents the air-fuel ratio in the exhaust gases upstream from the catalytic converter, the first air-fuel ratio sensor being quickly heated to the specified operating temperature by the exhaust gases after operation of the internal combustion engine is initiated;

a second air-fuel ratio sensor exposed to the exhaust gases in the exhaust means downstream from the catalytic converter, the second air-fuel ratio sensor having a negative temperature coefficient of resistance and being effective to generate a voltage thereacross when heated to the specified operating temperature that represents the air-fuel ratio of exhaust gases downstream from the catalytic converter, the second air-fuel ratio sensor being heated to the specified operating temperature by the exhaust gases after operation of the internal combustion engine is initiated a catalytic converter imposed time delay after the first air-fuel ratio sensor is heated to the specified operating temperature;

a resistor having a resistance much less than the impedance of the second air-fuel ratio sensor prior to initiation of operation of the internal combustion engine and subsequent heating of the second air-fuel ratio sensor;

means effective to couple the voltage generated by the first air-fuel ratio sensor across the series combination of the second air-fuel ratio sensor and the resistor, the voltage across the second air-fuel ratio sensor being influenced by the voltage generated by the first air-fuel ratio sensor in decreasing relationship with increasing temperature of the second air-fuel ratio sensor; and means responsive to the voltage across the first and second air-fuel ratio sensors effective to continually adjust the fuel and air supply means to vary the ratio of fuel and air supplied to the engine in a sense to reduce the deviation of the ratio of fuel and air in the exhaust means from the certain ratio.

2. For use with an internal combustion engine including means effective to supply air and fuel thereto in variable ratio and exhaust means including a catalytic converter effective, when supplied with exhaust gases containing air and fuel in a certain ratio, to accelerate simultaneously the oxidation of unburned fuel and the reduction of nitrogen oxides, apparatus for controlling the ratio of air and fuel in the exhaust system to the certain ratio, the apparatus comprising in combination:

a first air-fuel ratio sensor exposed to the exhaust gases in the exhaust means upstream from the catalytic converter, the first air-fuel ratio sensor having a negative temperature coefficient of resistance and being effective to generate a voltage thereacross when heated to a specified operating temperature that represents the air-fuel ratio in the exhaust gases upstream from the catalytic converter, the first air-fuel ratio sensor being quickly heated to the specified operating temperature by the exhaust gases after operation of the internal combustion engine is initiated;

a first unity gain amplifier having input and output terminals;

means effective to couple the voltage generated by the first air-fuel ratio sensor to the input terminal of the first unity gain amplifier;

a second air-fuel ratio sensor exposed to the exhaust gases in the exhaust means downstream from the catalytic converter, the second air-fuel ratio sensor having a negative temperature coefficient of resistance and being effective to generate a voltage thereacross when heated to the specified operating temperature that represents the air-fuel ratio of exhaust gases downstreamm from the catalytic converter, the second air-fuel ratio sensor being heated to the specified operating temperature by the exhaust gases after operation of the internal combustion engine is initiated a catalytic converter imposed time delay after the first air-fuel ratio sensor is heated to the specified operating temperature;

a second unity gain amplifier having input and output terminals and having high input impedance;

means effective to couple the voltage generated by the second air-fuel ratio sensor to the input of the second unity gain amplifier;

a resistor having a resistance much less than each of the input impedance of the second unity gain amplifier and the impedance of the second air-fuel ratio sensor prior to being heated upon initiation of operation of the internal combustion engine and subsequent heating of the second air-fuel ratio sensor;

means effective to couple the resistor between the output terminal of the first unity gain amplifier and the input terminal of the second unity gain amplifier;

the voltage at the output terminal of the second unity gain amplifier being influenced by the voltage generated by the first air-fuel ratio sensor in decreasing relationship with increasing temperature of the second air-fuel ratio sensor; and control means coupled to the output terminals of the first and second unity gain amplifiers effective to continually adjusting the fuel and air supply means to vary the ratio of fuel and air supplied to the engine in a sense to reduce the deviation of the ratio of fuel and air in the exhaust means from the certain ratio.

* * * * *